US005860568A

United States Patent [19]

Mallalieu et al.

[11] Patent Number: 5,860,568

[45] Date of Patent: Jan. 19, 1999

[54] NORMALLY-CLOSED NOZZLE TIP TRIMMER

[75] Inventors: Scott D. Mallalieu; Patrick D. Mallalieu, both of Palmer, Mass.

[73] Assignee: Hyde Tools, Southbridge, Mass.

[21] Appl. No.: 741,660

[22] Filed: Oct. 31, 1996

[51] Int. Cl.[6] ..... B67D 5/00; B26D 5/08; B26D 13/00

[52] U.S. Cl. ..... 222/83.5; 222/82; 222/326; 83/580; 30/226; 30/233; 30/261

[58] Field of Search ..... 222/83.5, 82, 326; 83/580; 30/233, 226, 1.5, 261

[56] References Cited

U.S. PATENT DOCUMENTS

| | | | |
|---|---|---|---|
| 3,089,241 | 5/1963 | Batdorf | 30/226 |
| 3,105,614 | 10/1963 | Sherbondy | 222/83.5 |
| 3,189,226 | 6/1965 | Sherbondy . | |
| 4,135,644 | 1/1979 | Pacetti | 222/81 |
| 4,158,914 | 6/1979 | Kurtz | 30/359 |
| 4,271,593 | 6/1981 | Smith | 30/233 |
| 4,390,115 | 6/1983 | Bigham | 222/326 |
| 4,493,437 | 1/1985 | Breeden | 222/82 |
| 4,802,607 | 2/1989 | Johnson | 222/82 |
| 5,079,838 | 1/1992 | Stallings, Jr. | 30/1.5 |

*Primary Examiner*—Andres Kashnikow
*Assistant Examiner*—Keats Quinalty
*Attorney, Agent, or Firm*—Lackenbach Siegel Marzullo Aronson & Greenspan, P.C.

[57] ABSTRACT

A dispensing apparatus, such as a caulking gun, includes an elongated handle having a U-shape cross section to define an internal space. A support member is mounted on the handle configured for receiving a dispensing cartridge having a nozzle at one end and being sealed at the other end by a slidable diaphragm or seal. A plunger rod and piston assembly is mounted on the handle for operatively engaging the cartridge diaphragm to dispense compounds or viscous mediums from the open nozzle of the cartridge. A trigger is pivotally attached to the handle for incrementally advancing the plunger assembly as the trigger is pulled from an extended position most remote from the handle to a retract position most proximate to the handle. A spring normally urges the trigger to move to the extended position. An aperture is provided in the handle for receiving at least a portion of a nozzle of a dispensing cartridge. A protective cover plate is responsive to the movements of the trigger for normally and automatically blocking the aperture in the handle and to filly open the aperture only when the trigger is moved to a selected intermediate retracted position. A cutter is provided within the space of the handle also responsive to movements of the trigger for snipping or trimming the nozzle of a dispensing cartridge after it has been inserted through the aperture, and the trigger is further retracted beyond the intermediate position to a more proximate position in the handle. In this way, at least a portion of a nozzle of a dispensing cartridge can be inserted through the aperture, the protective cover normally preventing any object, but particularly a finger, from passing through the aperture.

18 Claims, 7 Drawing Sheets

NORMALLY-CLOSED NOZZLE TIP TRIMMER

BACKGROUND OF THE INVENTION

1. Field of the Invention

This invention generally relates to caulking devices ("guns") of the type that use expendable caulking compound cartridges having nozzles whose tips need first be snipped off prior to use, and subsequently trimmed to provide a larger bead of the caulking compound or even cut on the bias (slanted) as desired by the user of the tool. Furthermore, this invention relates to any device containing a cartridge that dispenses a medium for any purpose, such as sealing or insulating, and can even be fabricated and marketed as a stand-alone device unattached to any dispensing mechanism and/or cartridge.

2. Description of the Prior Art

Many varieties of caulking guns exist, including those that provide an integral cutting device for snipping or trimming the nozzle tips of caulking compound cartridges, a necessary step prior to operating the caulking gun with an assembled cartridge. Typically, an aperture or hole is provided in a wall of the handle or hand grip; the aperture being configured and sized to receive at least a portion of the cartridge nozzle tip. In current art, a blade or cutting edge is attached to, or integral with, the trigger mechanism and is augmented by its normal pivoting motion, which when actuated to its fullest extent causes the blade or cutting edge to sweep past the aperture in the handle. The user need only insert the cartridge nozzle tip in the aperture and squeeze the trigger to snip the tip. Unfortunately, this snipping action occurs upon each and every trigger actuation, whether purposeful or inadvertent, and whether or not a caulk or sealant cartridge is installed. Hence the potential exists that someone unaware of the hazard, particularly a child, might insert his or her finger in the open aperture. Subsequent actuation, consequently, by anyone accessing the trigger could result in a serious injury.

For example, in U.S. Pat. No. 3,189,226 to Sherbondy, a shearing blade has a projection thereon which extends into a lost motion slot formed in one side of the trigger. The structure forms a shearing mechanism which is operable to trim the outlet end of a cartridge nozzle positioned in a hole in the handle. By pulling the trigger towards the handle, the blade is caused to move across the hole to shear off the end of the nozzle. A spring is provided for normally urging the trigger outwardly from the handle. In the normal or inoperative condition of the trigger, the cutting element clears the hole or opening in the handle to permit objects to pass through the hole or opening. This makes it possible for the user, or bystander, particularly a child, to pass a finger or fleshy part of the hand through the hole or opening prior to actuation of the trigger. Actuation, intentional or inadvertent, under those conditions, could cause serious injury.

A caulking gun is disclosed in U.S. Pat. No. 4,135,644 to Pacetti which includes a handle and an opening in the handle into which the nozzle of a caulking gun cartridge may be inserted. A knife blade is operatively attached to the trigger used to advance the ram that extrudes caulking compound from a cartridge. However, the caulking gun disclosed in this invention also normally exposes the opening provided in the handle through which a finger or fleshy part of the hand can pass when the trigger is fully extended. As with the previous patent, therefore, serious injury can result from misuse or inadvertence.

Another design of the caulking gun is disclosed in U.S. Pat. No. 4,390,115 to Bigham. Here, a plurality of holes of different sizes are provided in the handle of the gun, the holes being oval or elliptical in shape and having their edges beveled to form sharp edges on the inner side of the handle to act as a shear with a cooperating edge of the trigger when depressed into the handle. Aside from the shape of the holes, this caulking gun exhibits the same disadvantages or dangers inherent in the prior described designs, although, it may be that at least some of the smaller holes in Bigham may be too small for a finger or a fleshy part of the hand to pass therethrough. This is not the case in relation to the larger holes used in the disclosed caulking gun.

A tip trimmer assembly for a caulking gun is also disclosed in U.S. Pat. No. 4,802,607 to Johnson. One of its primary objectives is to provide a separate unit that can be used to retrofit existing caulking guns. Here, also, there is a cutting edge that sweeps over an aperture to snip the tip of a caulk cartridge nozzle therein inserted. This cutting edge may be detented in either open or closed aperture positions. In the former instance, the same hazard exists as for those configurations noted in the aforementioned patents.

SUMMARY OF THE INVENTION

Accordingly, it is one object of the present invention to provide a caulking gun which does not exhibit the disadvantages inherent in those prior art caulking gun designs that incorporate cartridge nozzle tip cutters.

It is another object of the present invention to provide a caulking gun which significantly enhances safety in the use of such guns and which is simple in construction and economical to manufacture.

It is still another object of the present invention to provide a caulking gun which is convenient to use and provides an enhanced level of inherent safety.

It is yet another object of the present invention to provide a caulking gun as in the previous objects which includes at least one aperture in the handle ("aperture", hereafter, signifies one or more) for receiving at least a portion of the tip of the dispensing nozzle of the caulking cartridge, the aperture being normally blocked or closed when the trigger of the caulking gun is in its normally extended, inoperative, position.

It is a further object of the present invention to provide a caulking gun as contemplated in the previous objects which specifically prevents or minimizes the risk of a user, or child, accidentally placing a finger or a fleshy part of the hand through the aperture intended to receive the tip of a cartridge dispensing nozzle prior to actuation of the trigger mechanism.

It is still a further object of the present invention to provide a caulking apparatus of the type under discussion which significantly enhances the safety of use of the caulking gun with minimal design changes and with minimal additional manufacturing costs.

In order to achieve the above objects, as well as others that will become apparent hereinafter to those skilled in the art, a caulking apparatus in accordance with the present invention comprises an elongate handle having a U shaped cross-section to define an internal space. A barrel is mounted on said handle which defines an axis and is configured for receiving a caulking cartridge arranged along said axis and having an operable (open) nozzle at one end of said cartridge, being closed at the other end by a slidable diaphragm or seal. A plunger rod and piston are mounted on said handle for operatively engaging the slidable diaphragm of the caulking cartridge to dispense caulking compound from its open nozzle at the other end when said rod and piston are advanced generally along said axis. Trigger means is pivotally attached to said handle for incrementally advancing said plunger assembly as said trigger means is actuated from its extended position most remote from said handle to a retracted position most proximate to said handle. Biasing means is provided for normally urging the trigger means to its fullest extended position. Said handle incorporates an aperture for receiving at least a portion of the nozzle of a caulking cartridge. A protective cover means responsive to movements of said trigger is provided for normally blocking said aperture in said handle when said trigger is fully extended (inoperative), opening or exposing said aperture and presenting access to the aligned nozzle cutting element (blade) only when said trigger is in a selected intermediate retracted position whereby the nozzle of a caulking cartridge can be inserted; but otherwise preventing any object, especially any portion of the user's or a bystander's finger, hand or body from passing through said aperture when said trigger is inoperative. Said cutting means is provided within said handle's internal space, also being responsive to movements of said trigger for snipping the tip or subsequently trimming the nozzle of a caulking cartridge after it has been inserted through said aperture and said trigger is further retracted and moved from said selected intermediate retracted position toward its most proximate position to the handle.

BRIEF DESCRIPTION OF THE DRAWINGS

Other objects and advantages of the present invention will become apparent from the following detailed description of its preferred embodiment when taken in conjunction with the drawings, as follows.

DESCRIPTION OF A PREFERRED EMBODIMENT

Figure 1:
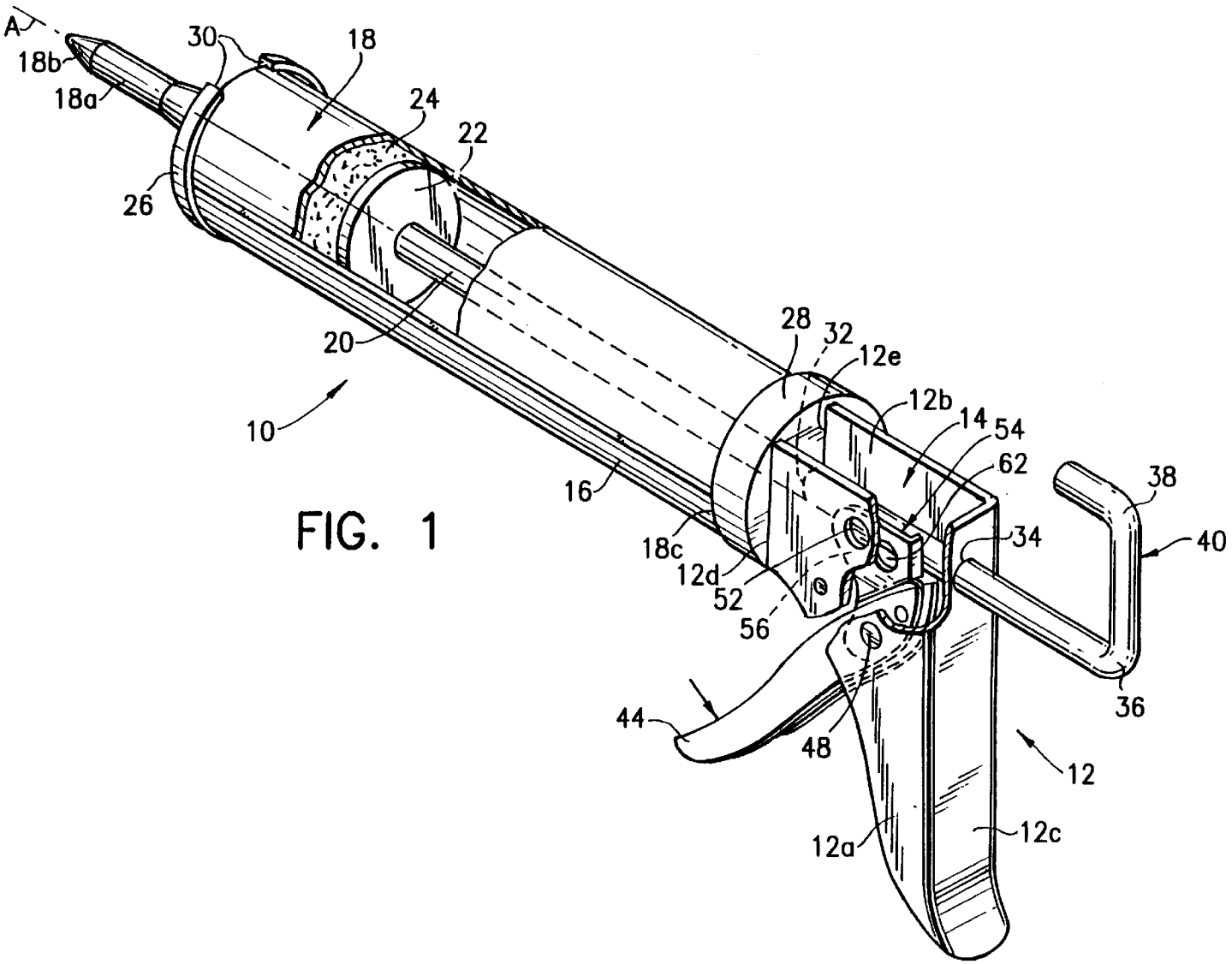
FIG. 1 is a perspective view of a hand-operated caulking gun in accordance with the present invention, being shown partially broken away to illustrate the caulking cartridge nozzle snipping mechanism.

Referring specifically to the figures, in which identical or similar parts are designated by the same reference numerals throughout, and first referring to FIG. 1, a hand-operated caulking gun in accordance with the present invention is designated by reference numeral 10.

The caulking gun 10 includes an elongate U-shaped handle 12. The handle 12 is formed of flat sheet material that is bent as illustrated to provide two spaced side walls 12*a* and 12*b* which are integrally connected to each other by a rear wall 12*c*. The handle 12, which is typical of handles used in prior art designs, forms an internal space 14 between the walls 12*a*, 12*b* and 12*c*.

Figure 3:
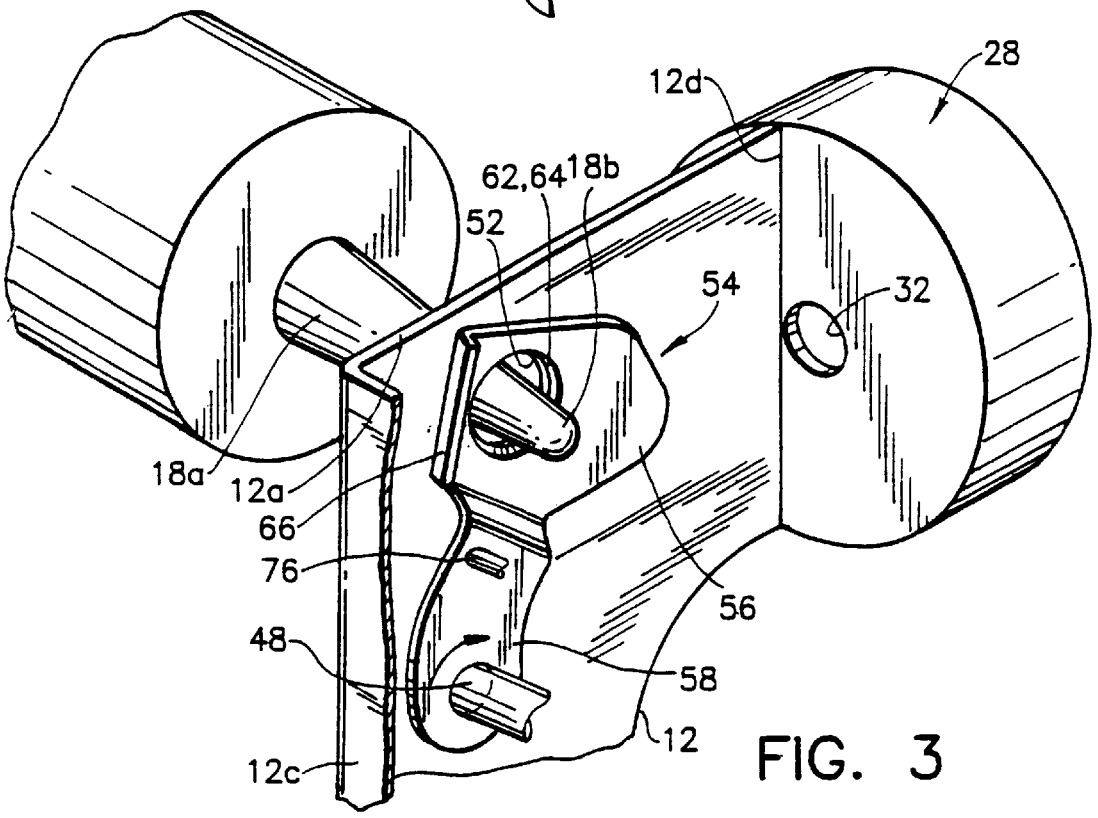
FIG. 3 is a perspective view of a cut-a-way portion of the caulking gun handle, but shown with the trigger mechanism and drive rod removed so as to expose the cutting element in its selected intermediated position as illustrated in FIG. 2B, which permits the insertion of a nozzle tip through the aligned handle and cutting blade holes.
Figure 3A:
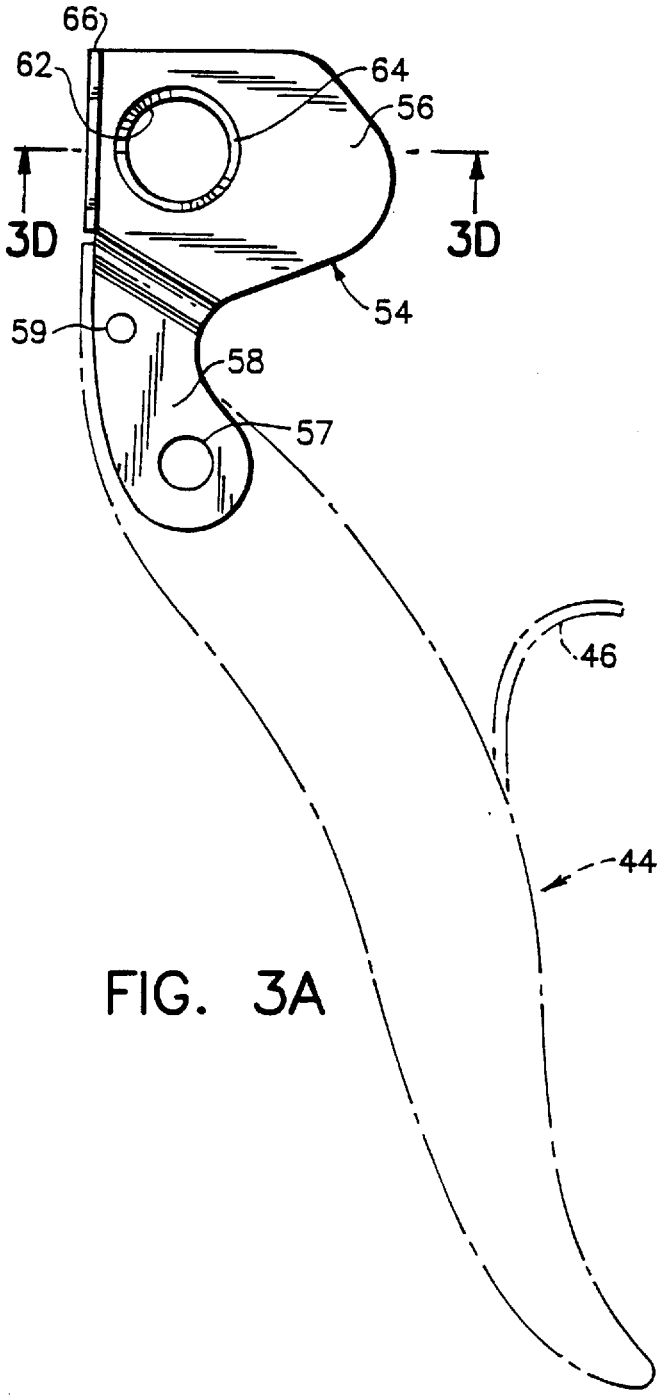
FIG. 3A is an enlarged side elevational view of the cutting device depicted in the previous figures and includes a phantom outline of the trigger. The two holes in the lower flange receive pins (the lowest being the trigger pivot) that engage corresponding holes in the trigger, thus interlocking it with the cutting device.
Figure 3B:
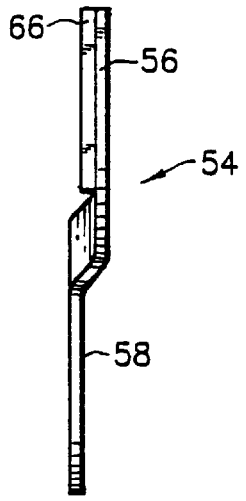
FIG. 3B is an end elevational view of the cutting device shown in FIG. 3A.
Figure 3C:
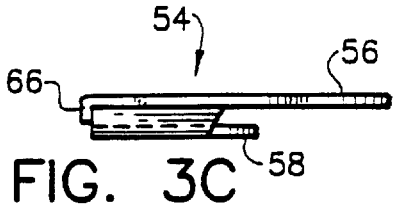
FIG. 3C is a top plan view of the cutting device shown in FIG. 3A.
Figure 3D:
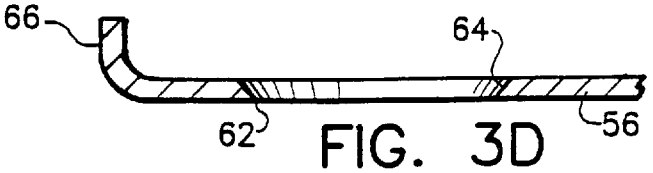
FIG. 3D is an enlarged fragmented cross section that shows the tapered (beveled) aperture in the cutting element or blade which forms the cutting edge for snipping or trimming caulking cartridge nozzle tips.

The U-shaped handle 12 has leading or front edges 12*d*, 12*e* at the end opposite the rear wall 12*c*, which are joined to barrel 16's rear end cap 28. Barrel 16 is semi-cylindrical for supporting a caulking or sealant cartridge 18, and is joined at one end to the rear end cap 28 and at the other to the front end cap 26. The latter incorporates radial slot 30 that allows passage of cartridge nozzle 18*a* during installation of cartridge 18, said nozzle 18*a* becoming operable once its enclosed tip 18*b* is "snipped" (FIGS. 1 and 3), and its internal sealing membrane (not shown) pierced. Front and rear end caps 26 and 28, respectively, form longitudinal location and restraint for cartridge 18.

The common centerlines of barrel 16 and end caps 26, 28 define an axis A along which the centerlines of cartridge 18, piston 22 and drive rod 20 are aligned. Piston 22 operatively engages a slidable diaphragm or seal (not shown) at the rear end 18*c* of cartridge 18. As drive rod 20 and piston 22 are advanced along axis A by drive lug 72 (its biasing spring not shown), which is urged forward as trigger 44 is retracted (FIGS. 2A–2C), caulking or sealing compound 24 is dispensed through the opening in nozzle 18*a*. Repetitive trigger retractions (and extensions) that incrementally advance the drive rod and piston are required to fully dispense the caulking from the cartridge.

Drive rod 20 is assembled through holes 34, 32 in rear handle wall 12*c* and rear end cap 28 respectively. In the depicted embodiment 10, drive rod 20 incorporates ratchet "teeth" 70 along its lower longitudinal edge (not shown in FIG. 1, but shown in FIGS. 2A–2C) which are incrementally engaged by drive lug 72 in response to repetitive actuations of trigger 44, which when "pulled" (retracted) by the operator urges drive lug 72 to forwardly thrust the most proximate rod tooth 70*a,* advancing drive rod 20 and piston 22 deeper into cartridge 18, thus dispensing a proportionate amount of caulk compound 24 through the open cartridge nozzle 18*a*. Spring 50 biases trigger 44 by urging it to pivot counterclockwise (in FIGS. 2A–2C) about pivot pin (rivet) 48 and to, therefore, automatically return to its fully extended, inoperative position after each retraction and release cycle. The handle pivot pin 48 is mounted in holes through handle sidewalls 12*a,* 12*b*.

Drive lug 72 is urged to pivot counterclockwise (in FIGS. 2A–2C) about pivot pin (rivet) 76 by a biasing spring (not shown) that causes said drive lug 72 to maintain "spring loaded" contact with teeth 70 of drive rod 20 as trigger 44 returns to its fully extended position after each actuation. The pivot pin 76 is mounted in holes through the upper portions of trigger 44 sidewalls located above trigger pivot pin 48. Trigger 44 typically incorporates finger guard 46 which prevents pinching of the "trigger finger" between the trigger and underside of barrel 16 as said trigger 44 returns to its fully extended position subsequent to each actuation.

Latching lug 74 is urged to pivot counterclockwise (in FIGS. 2A–2C) about pivot pin 78 by a biasing spring (not shown) that causes said latching lug 74 to maintain "spring loaded" contact with teeth 70 whenever trigger actuation (retraction) is initiated to advance drive rod 20. Upon trigger release and extension, latching lug 74, through engagement with the most proximate drive rod tooth 70*b,* restrains rod 20 from rearward movement that would otherwise result from residual pressure in the caulk/sealant cartridge 18, thus allowing drive lug 72 to freely engage the newly presented and now most proximate drive rod tooth 70*a* preparatory to the next trigger actuation. Latching lug pivot pin 78 is assembled through holes in handle 12 sidewalls 12*a,* 12*b*.

Bends 36, 38 in rearwardly extending portion of drive rod 20 (FIG. 1), along with intermediate connecting section 40, form an integral handgrip for retracting said rod 20 in order to remove and replace an empty cartridge 18. (In the depicted embodiment, rod 20 would be rotated approx. 90° to 180° during retraction so teeth 70 would clear lugs 72 and 74, which otherwise would maintain their engagement with rod teeth 70*a*, 70*b*, preventing rod 20 from rearward retraction.)

Because a caulk/sealant tube or cartridge is not rendered useable until at least a portion of the tip 18*b* of the dispensing nozzle 18*a* is cut or sheared off to provide an opening therein, many existing caulking guns include an integral snipping or trimming mechanism so that the caulking gun becomes a self-contained tool without the need, therefore, to rely on additional tools or implements for trimming the nozzle. Such mechanisms, however, invariably incorporate a "normally-open" nozzle access hole (aperture) which poses the hazard previously stated.

Figure 2A:
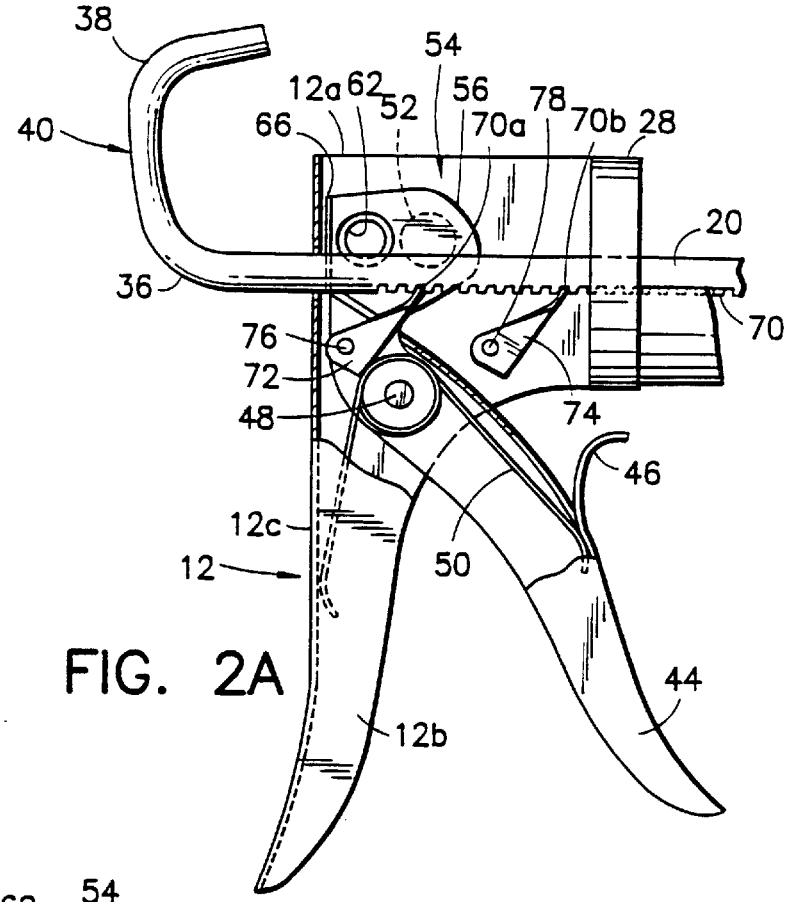
FIG. 2A is a fragmented side elevational view, shown partially in cross section, to illustrate the trigger mechanism in its normal, extended (inoperative) state as well as the corresponding position of the cutting device, in accordance with the present invention, in its blocking or closed-aperture position.
Figure 2B:
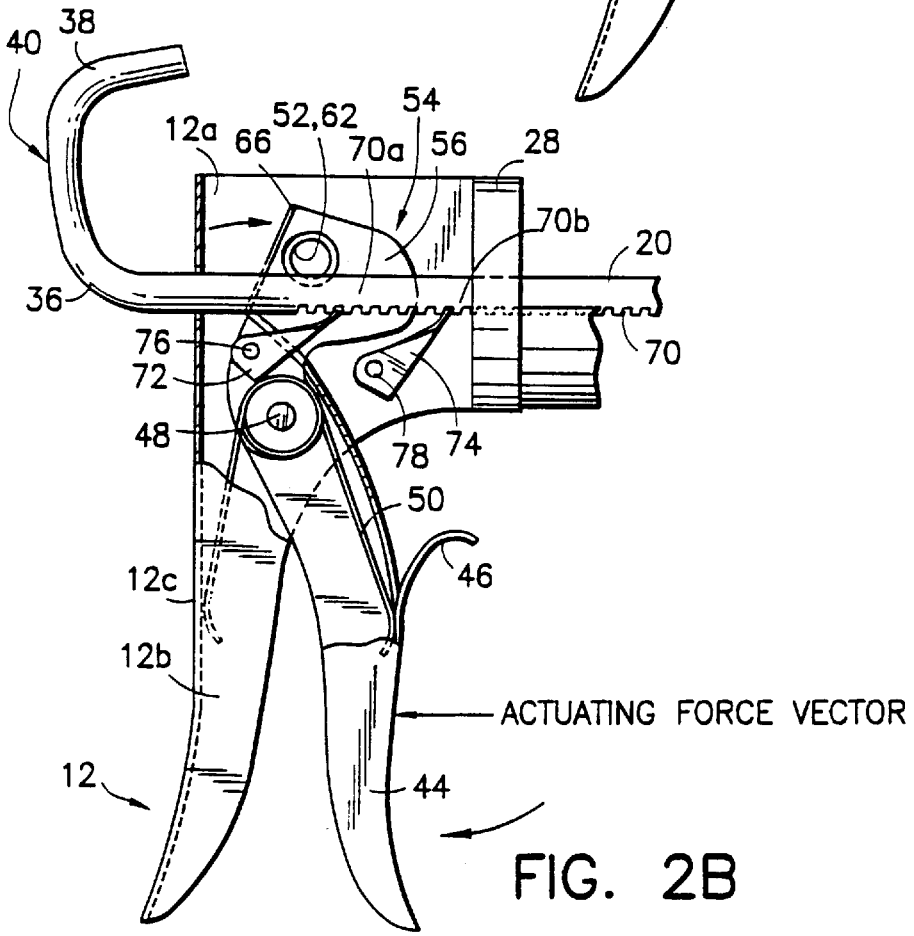
FIG. 2B is similar to FIG. 2A, except that it shows the trigger at a selected intermediate retracted position that aligns the cutting element or blade (the sharpened edge of the hole in the pivoting member attached above the trigger) with the aperture in the side wall of the handle (a hole of similar size) thereby permitting insertion of a nozzle tip through both the blade and handle apertures (holes) prior to snipping.
Figure 2C:
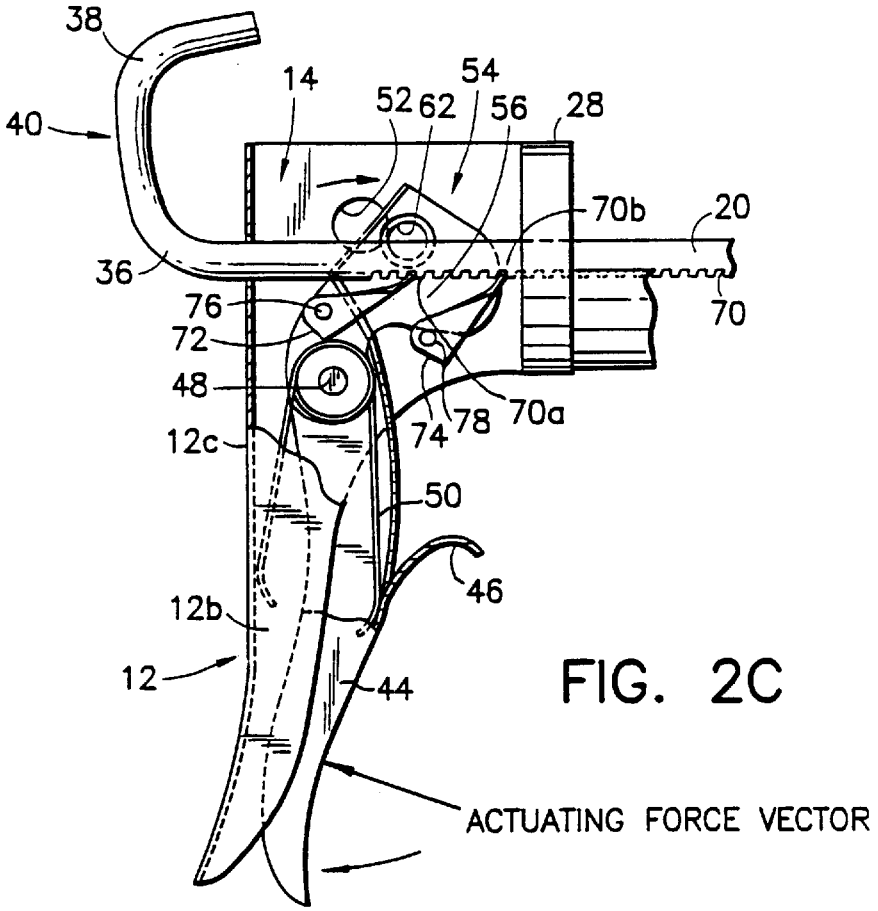
FIG. 2C is similar to FIGS. 2A and 2B but shows the trigger in its fully retracted position resulting from the motion required to completely sever a cartridge nozzle tip.

An important feature of the present invention is the provision of a cutting device 54, depicted in every figure, which incorporates a protective cover or blocking element 56 that is responsive to movement of trigger 44 for normally blocking aperture 52 in handle sidewall 12*a* whenever trigger 44 is fully extended (inoperative) as shown in FIGS. 1 and 2A, and only opening (exposing) aperture 52 when trigger 44 is in a selected intermediate retracted position as illustrated in FIG. 2B. In this position, hole 52 in the handle sidewall 12*a* and a hole 62, formed by a circular cutting edge, in the cutting device 54, are generally aligned, allowing insertion of nozzle 18*a* for initial snipping of tip 18*b,* or subsequent trimming, either effect being accomplished by further retraction of trigger 44 to, virtually, its most proximate position relative to handle end wall 12*c* (FIG. 2C).

Although the protective cover or blocking element 56 can take on numerous shapes or forms, the preferred embodiment illustrated in FIGS. 3A–3D takes full advantage of existing caulk gun "art" to minimize the impact, and cost, of incorporating this invention. The only change in many cases, as those skilled in the art will recognize, and as depicted in FIG. 1, is substitution of cutting device 54 for the currently employed guillotine style blade for snipping nozzle tips. A slight relocation of the nozzle access hole (aperture) 52 in handle sidewall 12*a* is typically required to optimize cutting device 54's design.

As in existing art, cutting device 54 (FIGS. 3A–3C) incorporates a lower offset mounting flange 58 having holes 57 and 59 through which pass handle 44 pivot pin (rivet) 48 and drive lug 72 pivot pin (rivet) 76, respectively, thus interlocking said cutting device 54 and said trigger 44, causing them to move in unison whenever the latter is actuated. The offset in blade mounting flange 58 (FIGS. 3B, 3C) accommodates the lateral distance between the inner surface of handle sidewall 12*a* and the inner surface of the most proximate trigger 44 sidewall (adjacent which flange 58 mounts) so as to allow cutting edge 62 of beveled hole 64 in cutting device 54 (FIG. 3D) to lie flush upon and move parallel with said inner surface of handle sidewall 12*a;* thereby effecting a "clean" and efficient snipping of nozzle 18*a* and/or tip 18*b* whenever cutting device 54 is employed.

While the cutting hole 62 is shown to be beveled about its entire periphery (FIGS. 3A, 3D), it will be clear to those skilled in the art that only a portion of the periphery of such a cutting hole needs to be sharp in order to effectively snip or trim the nozzle. Thus, only the rearward portion of the hole's periphery most proximate to the rear handle wall 12*c* need be sharpened so that when trigger 44 is fully retracted the sharpened portion of the cutting hole, as it is propelled forward, will shear the nozzle. However, in some instances, such as the embodiment herein illustrated, the entire cutting hole periphery may be sharpened (beveled) to effect manufacturing simplification and economy.

Cutting device 54 is optimally fabricated from approx. 1/32 inches thick hardened steel, whereas handle 12 and trigger 44 are typically made from 1/16 inches thick cold rolled steel. Other thicknesses, materials and hardness are feasible.

Aperture cutting edge 62 in device 54 is arranged to fully clear the nozzle access hole 52 in handle sidewall 12*a,* as shown in FIG. 2C, when trigger 44 is fully retracted. This assures complete and efficient snipping of cartridge nozzle tip 18*b* or subsequent trimming of open nozzle 18*a,* but also, at least momentarily, allows the inadvertent or even deliberate insertion of an object or finger through the temporarily exposed hole 52. Subsequent release of trigger 44 would therefore pinch said object or finger between the "trailing" (rearward) edges of device 54 and access hole 52.

In accordance with a special feature of the present invention, there is preferably provided an additional safety means to minimize or eliminate injury or discomfort to any portion of a user's (or bystander's) finger or hand thus inserted through hole 52 prior to release of trigger 44 from its fully retracted position, whereby its subsequent inadvertent or purposeful release would allow the biasing force of spring 50 that normally returns trigger 44 to its fully extended position to now instead cause said inserted finger to be pinched or trapped between rearward trailing edges of hole 52 and device 54.

This additional safety means as illustrated in each figure of the preferred embodiment is the integral edge guard 66 on the rearward, trailing edge of device 54. Guard 66 is a simple upturned edge approx. ⅛ inch wide with 90° bend extending inwardly into space 14, and is generally perpendicular to the plane of cutting edge 62 and handle sidewall 12*a,* also being generally perpendicular to the trajectory (arc of travel) of the center point of circular cutting edge 62 as it pivots about pivot pin 48 of handle 44. The guard 66 presents a force distribution surface to any object, finger or other hand or body part that might be inserted through hole 52 when trigger 44 is fully retracted, and become subsequently entrapped or pinched upon release of said trigger.

Those skilled in the art will readily recognize that the leveraged biasing force of trigger spring 50 when distributed over the relatively large area (⅛ inch wide) of edge guard 66 is virtually innocuous compared with the sharp concentration of the same force on the otherwise thin edge (approx. 1⁄32 inch thick) of device 54 if devoid of said guard. Likewise, the approx. 1⁄16 inch thick edge of access hole 52 in handle sidewall 12*a,* whose rearward edge portion forms the opposing pinch point, is also less hazardous than the 1⁄32" thick edge of device 54, if without edge guard 66.

Many feasible configurations and materials exist for such an edge guard 66, whether integral, as in the preferred embodiment, or separately fabricated and subsequently assembled to cutting device 54.

As will be noted from the figures, the illustrated arrangement places cutting blade 62 on the opposite side of pivot pin 48 from trigger 44. This places blade 62 (and protective cover 56) squarely within the space 14 defined by handle sidewalls 12*a,* 12*b* and rear wall 12*c*. Furthermore, in order to provide the maximum mechanical advantage within the practical limitations of the preferred embodiment, so as to minimize the amount of trigger squeezing force required to snip or trim the nozzle and tip 18*a,* 18*b,* the aperture or hole 62 which includes the beveled cutting edge 64 is spaced from the centerline of pivot pin 48 a distance which is preferably significantly less than the distance from pivot 48's centerline to the actuating force vector of the operator's hand and fingers when squeezing trigger 44. In most state-of-the-art caulk guns, the aforementioned ratio is approx. 1:2, yielding a mechanical advantage of approx. 2:1. This is an efficient design for the cutting device that is easy and convenient to use.

Figure 4B:
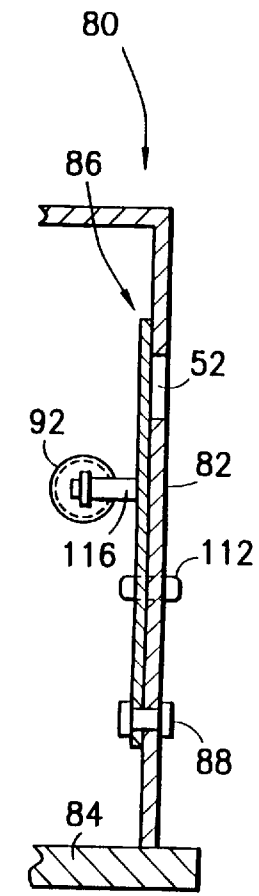
FIG. 4B is a cross-sectional view of the nozzle tip trimmer shown in FIG. 4A, taken along line 4B—4B.
Figure 4A:
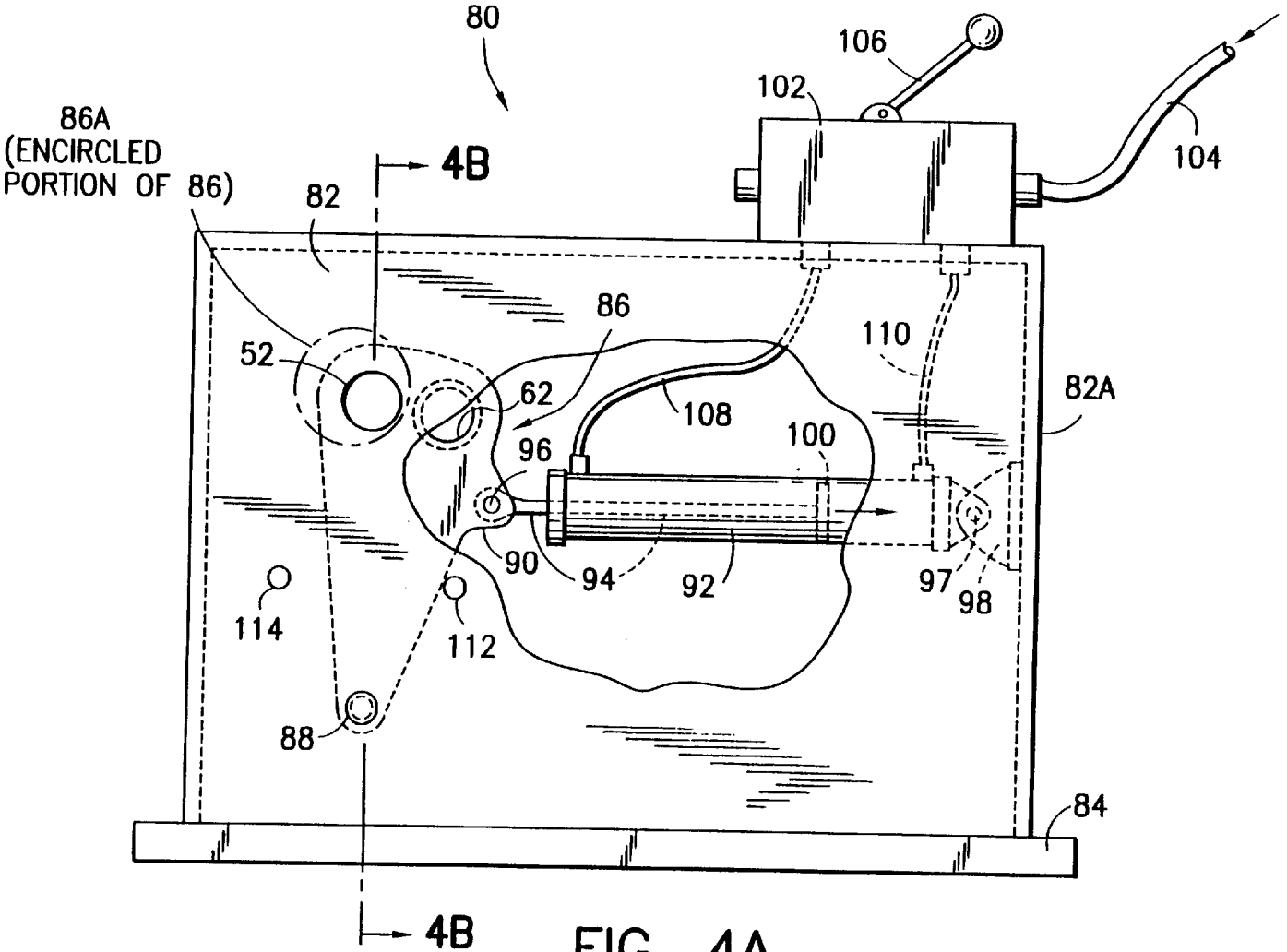
FIG. 4A is a front elevational view of a stand-alone nozzle tip trimmer in accordance with the present invention, shown partially broken away, and showing the device in the inoperative, normally closed position in which the nozzle access hole is blocked.

Referring to FIGS. 4A–4B, a stand-alone nozzle tip trimmer incorporating the features of the present invention is illustrated and generally designated by the reference numeral 80.

The stand-alone nozzle tip trimmer 80 includes a housing side wall or other suitable support structure 82 which is provided with a nozzle access hole 52, as with the previous embodiment 10. The side wall 82 is suitably supported on a base 84, or may be supported in any suitable or conventional way.

The operative components are mounted to one side of the side wall 82, as best shown in FIG. 4B, similar to the placement of the operative components of the embodiment 10 illustrated in FIG. 1. Thus, a cutting device 86, having a hole or circular cutting edge 62, is pivotally mounted on the side wall 82 by means of pivot pin 88. The cutting device 86 preferably has a portion 90 suitable for attachment to a double-acting cylinder 92 by means of a shaft, plunger or rod 94 and a pin 96 at one end of the cylinder 92. The other end of the cylinder 92 is connected, by means of a pin 97, to a bracket 98 fixed on the back wall 82A. The double-acting cylinder 92 may be conventional and includes a piston 100 connected to the plunger 94. The opposing ends of the cylinder 92, to each side of the piston 100, are connected to a switching valve 102 connected to a source air or hydraulic pressure 104. The operation of the valve and, therefore, the nozzle tip trimmer, may be by a handle or lever 106 to selectively apply air or hydraulic pressure to one of the lines 108 or 110 connected to opposite ends of the cylinder 92. It will be clear, therefore, that depending on the position of the handle or lever 106, the piston 100 will be moved to the right or to the left, as viewed in FIG. 4A, to rotate the blade 86 in a clockwise or counterclockwise direction, again as viewed in FIG. 4A. A retraction stop 112 and an extension stop 114 may be used to limit the maximum extent of retraction and extension of the cylinder 92. Depending on the size and position of the double-acting cylinder 92, the stops 112, 114 may be omitted, as the travel of piston 100 as well , of course, of shaft 94 may be selected to correspond with the fully retracted and extended positions required by the circular cutting blade 62 and, therefore, the maximum clockwise and counterclockwise rotational movements of the cutting device 86. One important feature of this arrangement is that the hole 52 in the side wall 82 be aligned with the circular cutting edge or hole 62 in the cutting device 86 only when the shaft 94 is fully extended, and/or when the cutting device 86 is brought to a stop by the extension stop 114. Such alignment allows a nozzle to be inserted through both aligned openings, as discussed previously. However, in the retracted, inoperative, position of shaft 94, when the cutting device 86 is brought to a stop by retraction stop 112, the nozzle access hole 52 and circular cutting blade 62 are out of alignment, with hole 52 being substantially or completely covered by the forwardly extending portion 86A of cutting device 86, thus preventing insertion of a nozzle, or any other object or anatomical appendage, through hole 52 and/or circular cutting blade 62.

In operation, the nozzle snipping action occurs during the retraction phase, subsequent to extension of the cutting device 86 to a position that aligns the circular cutting edge 62 with the nozzle access hole 52.

Figure 4D:
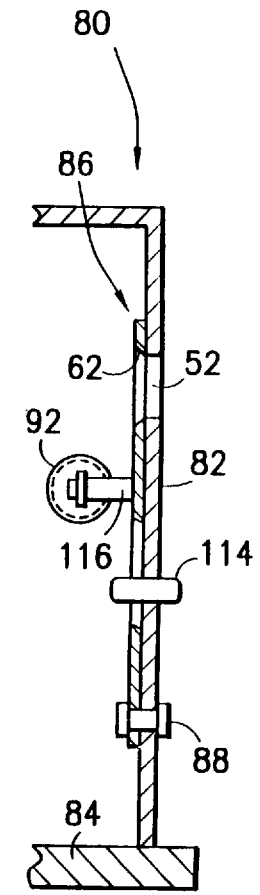
FIG. 4D is a cross-sectional view of the nozzle tip trimmer shown in FIG. 4C, taken along line 4D—4D.
Figure 4C:
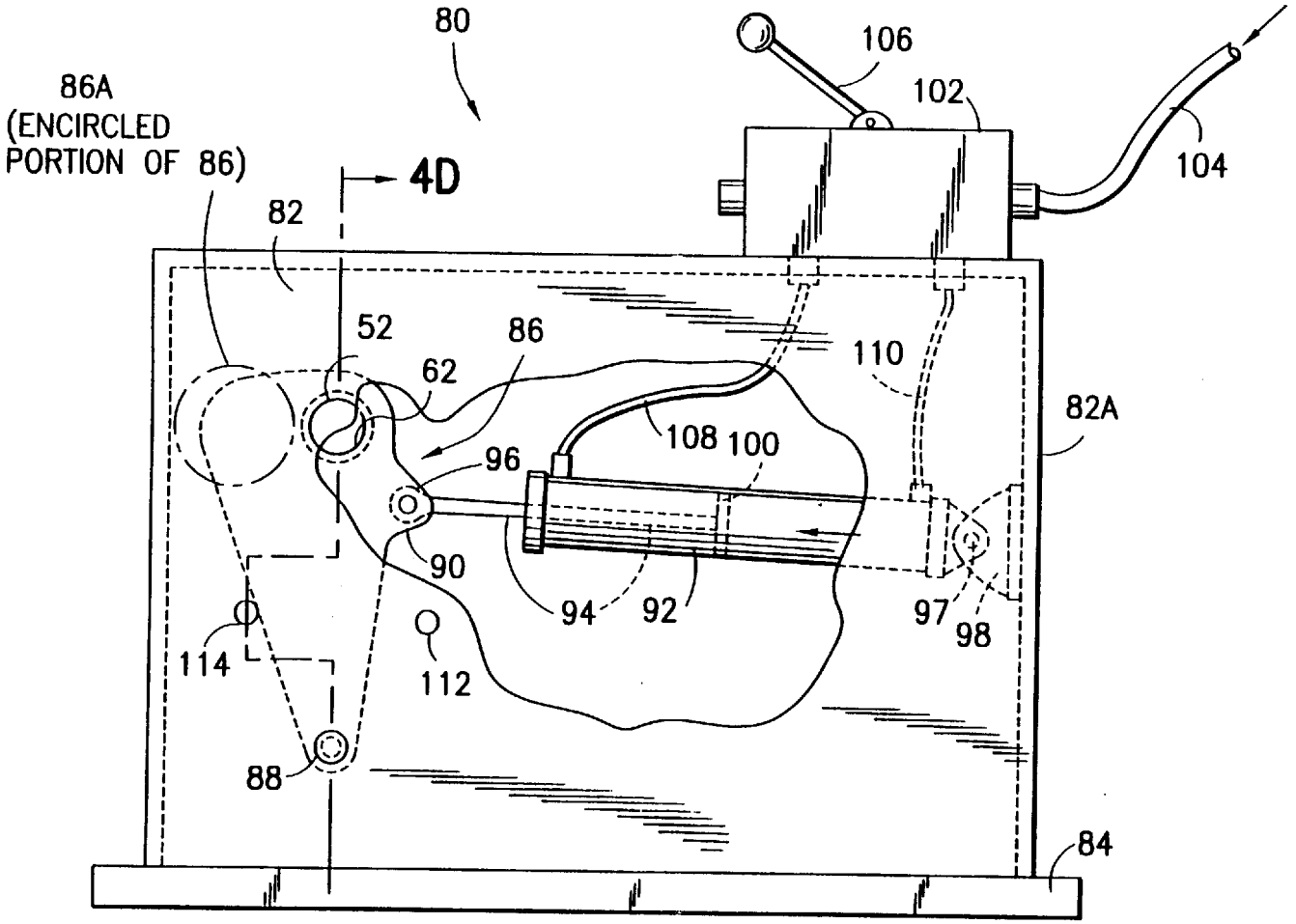
FIG. 4C is generally similar to FIG. 4A, but illustrates the nozzle tip trimmer in its normally-closed operative position in which the nozzle access hole is aligned with the hole formed by the circular edge cutting blade.

As best shown in FIGS. 4B and 4D, a stand-off 116 is preferably provided between the end of the cylinder rod or shaft 94 and the cutting device 86, where they are attached. This is required because the cylinder 92 is located well within the confines of the housing 82, whereas the cutting device 86 necessarily hugs the inside of the housing side wall 82. Other arrangements could be selected such as an "in-line" cylinder, but this would necessitate a differently shaped housing. Indeed, there are a variety of configurations and types of actuations that can perform the function of positioning the cutting element 86 in its fully extended and retracted positions while providing sufficient force to snip nozzle tips.

While the embodiment illustrated in FIGS. 4A–4D uses a double-acting cylinder for actuating the cutting device 86, a gear or lever system could alternatively be employed. Further, the double-acting cylinder 92 could utilize either air or hydraulic pressure, which, in turn, could be applied by a solenoid or a manually actuated switching valve, the latter being shown.

In FIGS. 4A and 4B, the shaft or rod 94 is shown in its fully retracted position, as the trimmer 80 would be in its inoperative, normally-closed position, in which the nozzle access hole 52 is blocked. However, in FIGS. 4C and 4D, the cylinder 92 is shown in its fully extended position, in which the hole 52 is aligned with the circular cutting edge 62 to allow a nozzle tip to be inserted for snipping.

Figure 5A:
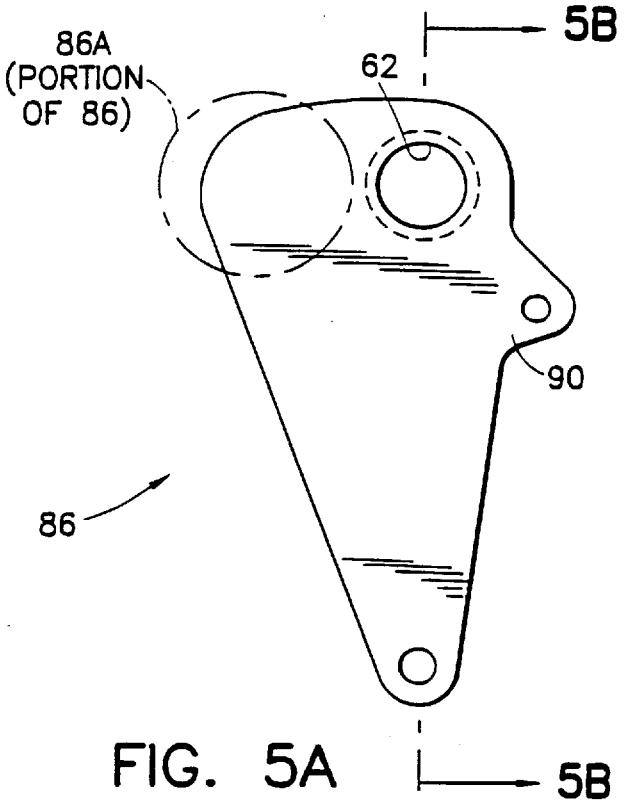
FIG. 5A is a side elevational view of the cutting blade used in the nozzle tip trimmer illustrated in FIGS. 4A–4D, showing the details of such blade.
Figure 5B:
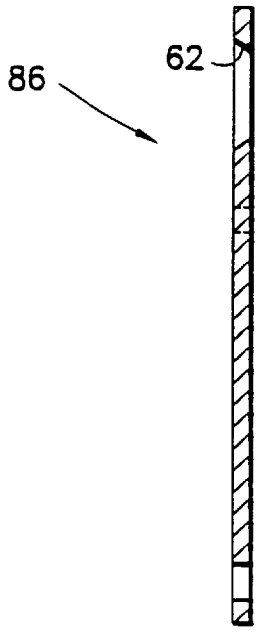
FIG. 5B is a cross-sectional view of the cutting blade shown in FIG. 5A taken along line 5B—5B.

The details of the cutting device 86 used in the embodiment shown in FIGS. 4A–4D are illustrated in FIGS. 5A and 5B.

Although multiple embodiments of the invention have been illustrated and described, it is to be understood that the invention is not limited thereto. There are, for instance, other feasible arrangements to which this invention may apply that will have greater or lesser mechanical advantage, and even arrangements that will locate the cutting element on the same side of pivot 48 as the trigger 44 in the caulk gun embodiment. Furthermore, there exists another common type of caulk gun to which this invention may also apply that utilizes a smooth (toothless) drive rod rather than the herein described "ratchet" (toothed) version; the former employing drive and latching lugs incorporating holes therein through which the rod passes; said rod thus being driven forward by the friction force resulting from the "gripping" action, when tilted, of the close fitting lugs on the drive rod.

Other potential embodiments include multiple cartridge nozzle access holes of varying sizes and shapes.

Therefore, various changes in the construction and arrangement of the components may be made without departing from the spirit of the invention, as will be apparent to those skilled in the art; reference being made to the appended claims for a definition of the limits of the invention.

We claim:

1. A dispensing apparatus, such as a caulk gun, comprising an elongated handle having a U-shaped cross-section to define an internal space; a support member mounted on said handle configured for receiving a dispensing cartridge having a nozzle at one end and being sealed at the other end by a slidable diaphragm or seal; a plunger rod and piston assembly mounted on said handle for operatively engaging said cartridge diaphragm to dispense "compounds" or viscous medium from the open nozzle of said cartridge; trigger means pivotally attached to said handle for incrementally advancing said plunger assembly as said trigger means is moved from an extended position most remote from said handle to a retracted position most proximate to said handle; biasing means for normally urging said trigger means to said extended position; at least one aperture in said handle for receiving at least a portion of a nozzle of a dispensing cartridge; protective cover means responsive to the movements of said trigger means for normally and automatically blocking said aperture(s) in said handle and fully opening said aperture(s) only when said trigger means is moved to a selected intermediate retracted position and cutting means within said space of said handle responsive to movement of said trigger means for snipping or trimming the nozzle of a dispensing cartridge after it has been inserted through said aperture(s) and said trigger means is further retracted beyond said intermediate position to a more proximate position to said handle, whereby at least a portion of a nozzle of a dispensing cartridge can be inserted through said aperture(s); said protective cover normally preventing any object, but particularly a finger, from passing through said aperture.

2. A caulking apparatus as defined in claim 1, wherein said handle is formed of two spaced sidewalls generally parallel to said axis and integrally connected to each other by a rear wall, said aperture(s) being provided in one of said sidewalls.

3. A caulking apparatus as defined in claim 2, wherein said protective cover comprises an integral forwardly extending solid portion of the cutting means, being connected to said trigger means for sharing the pivotal movements thereof in relation to said handle and movable within a plane generally parallel and adjacent to one of said sidewalls.

4. A caulking apparatus as defined in claim 3, wherein said protective cover permits access to said aperture(s) in said handle only when said trigger means is moved to said selected intermediate retracted position thereby bringing said cutting element(s) into alignment with said aperture(s) in said handle.

5. A caulking apparatus as defined in claim 4, wherein said cutting means includes a hole(s) generally of the same diameter as said aperture(s) in said handle, whereby movement of said trigger means to said selected intermediate retracted position substantially aligns said hole(s) in said cutting means with said aperture(s) in said handle sidewall.

6. A caulking apparatus as defined in claim 5, wherein said hole(s) in said cutting means incorporates a beveled edge around at least a portion of its periphery.

7. A caulking apparatus as defined in claim 6, wherein said hole(s) in said cutting means comprises a beveled edge around its entire periphery.

8. A caulking apparatus as defined in claim 4, wherein said cutting device includes first and second planar portions which define offset planes that are generally parallel to said handle sidewalls; said first planar portion being mounted on said trigger means and being spaced from said apertured sidewall, allowing said second planar portion which incorporates both said protective cover and cutting blade to maintain sliding contact with said apertured sidewall, thus providing effective shearing action sufficient for snipping and trimming cartridge nozzles.

9. A caulking apparatus as defined in claim 4, wherein said cutting element(s) is arranged to be in a predetermined position that fully clears said aperture(s) in said handle sidewall when said trigger means is moved to a fully retracted position; and further comprising safety means for preventing injury and minimizing discomfort to any portion of the user's or bystander's finger or hand should it be inserted through said apertures(s) prior to release of said trigger means from its fully retracted position towards its fully extended position in response to the force of said biassing means.

10. A caulking apparatus as defined in claim 9, wherein said cutting element(s) is moveable along a predetermined direction from said predetermined position; and said safety means includes force distribution means in the form of an enlarged area on the rearward edge of said cutting device, whereby movement of said trigger means toward said extended position with concomitant movement of said cutting element(s) over said apertures(s) in said handle sidewall distributes said attendant trigger biasing force over said safety means contact area with any object that is inserted into said apertures(s).

11. A apparatus as defined in claim 10, wherein said force distribution means comprises a turned up portion on the rearward edge of said cutting device which is substantially perpendicular to said second planar portion of said cutting device, as well as to said predetermined direction of its movement.

12. A caulking apparatus as defined in claim 11, wherein said trigger means is attached to said handle about a pivot pin, and said protective cover means is arranged on the opposite side of said pivot pin from said trigger means.

13. A apparatus as defined in claim 12, wherein said protective cover means and said trigger means pivot about said pivot pin.

14. A caulking apparatus as defined in claim 11, wherein said cutting device comprises a metal blade.

15. A caulking apparatus as defined in claim 14, wherein said metal blade is made of hardened steel.

16. A caulking apparatus as defined in claim 14, wherein said metal blade has a thickness of approximately 1/32 inch.

17. A caulking apparatus as defined in claim 12, wherein the centerline of said cutting element(s) is spaced from said pivot pin a distance significantly less than that from the pivot pin to the actuating force vector of the user's hand and fingers when squeezing the trigger.

18. A caulking apparatus as defined in claim 17, wherein the distance from said pivot pin to the actuating force vector of the user's hand and fingers on the trigger is at least twice the distance from said pivot pin to the centerline of said cutting element(s).

* * * * *